US012235090B2

(12) United States Patent
Biard et al.

(10) Patent No.: US 12,235,090 B2
(45) Date of Patent: Feb. 25, 2025

(54) WIRELESS ELECTRONIC DETONATOR COMPRISING A POWER SWITCH CONTROLLED BY AN OPTICAL SIGNAL, WIRELESS DETONATION SYSTEM AND METHOD FOR ACTIVATING SUCH A DETONATOR

(71) Applicants: COMMISSARIAT A L'ENERGIE ATOMIQUE ET AUX ENERGIES ALTERNATIVES, Paris (FR); Davey Bickford, Hery (FR)

(72) Inventors: Lionel Biard, Grenoble Cedex (FR); Bernard Piaget, Grenoble Cedex (FR); Mélanie Descharles, Grenoble Cedex (FR); Vincent Berg, Grenoble Cedex (FR); Franck Guyon, Auxerre (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 244 days.

(21) Appl. No.: 17/783,623

(22) PCT Filed: Dec. 7, 2020

(86) PCT No.: PCT/FR2020/052324
§ 371 (c)(1),
(2) Date: Jun. 8, 2022

(87) PCT Pub. No.: WO2021/116584
PCT Pub. Date: Jun. 17, 2021

(65) Prior Publication Data

US 2023/0036978 A1 Feb. 2, 2023

(30) Foreign Application Priority Data

Dec. 9, 2019 (FR) ..... 1913940

(51) Int. Cl.
*F42D 1/05* (2006.01)
*F42B 3/113* (2006.01)

(52) U.S. Cl.
CPC ..... *F42D 1/05* (2013.01); *F42B 3/113* (2013.01)

(58) Field of Classification Search
CPC ..... F42D 1/05; F42B 3/113
See application file for complete search history.

(56) References Cited

U.S. PATENT DOCUMENTS 6,166,452 A 12/2000 Adams et al.
6,253,679 B1 * 7/2001 Woodall ..... F42C 13/047 102/221

(Continued)

FOREIGN PATENT DOCUMENTS

CN 208269739 U 12/2018
EP 2075526 A1 7/2009

(Continued)

OTHER PUBLICATIONS

New Zealand Patent Examination Report 2, Aug. 30, 2024, pp. 1-6, issued in Application No. 790146, New Zealand Intellectual Property Office.

*Primary Examiner* — J. Woodrow Eldred
(74) *Attorney, Agent, or Firm* — Crowell & Moring LLP

(57) ABSTRACT

A wireless electronic detonator includes a primary source of energy and at least one functional module. A power switch is disposed between the primary source of energy and the functional module to connect or disconnect the functional module and the primary source of energy. A controller controls the power switch and includes an optical receiver to detect and demodulate a light signal emitted by a control console, The controller generates a control signal according to the demodulated light signal to at least control the power switch. A wireless detonation system includes the wireless (Continued)

electronic detonator and the control console configured to emit a light signal, and method for activating the wireless electronic detonator.

24 Claims, 3 Drawing Sheets

(56) References Cited

U.S. PATENT DOCUMENTS

| | | | |
|---|---|---|---|
| 6,470,801 | B1 | 10/2002 | Swart et al. |
| 2011/0155012 | A1 | 6/2011 | Perez Cordova et al. |
| 2017/0074625 | A1 | 3/2017 | Appleby et al. |
| 2020/0278187 | A1 | 9/2020 | Biard et al. |

FOREIGN PATENT DOCUMENTS

| | | | |
|---|---|---|---|
| EP | 2093534 | A1 | 8/2009 |
| EP | 2352980 | A1 | 8/2011 |
| JP | 06-019024 | U | 3/1994 |
| JP | 2000-055594 | A | 2/2000 |
| JP | 2011-12903 | A | 1/2011 |
| WO | 2006047823 | A1 | 5/2006 |
| WO | WO 2006/096920 | A1 | 9/2006 |
| WO | 2014057421 | A1 | 4/2014 |
| WO | 2019/073148 | A1 | 4/2019 |

* cited by examiner

Fig.1
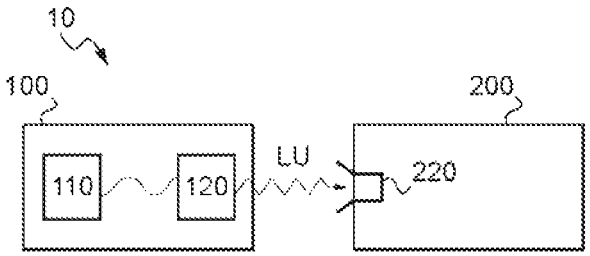
Fig.2
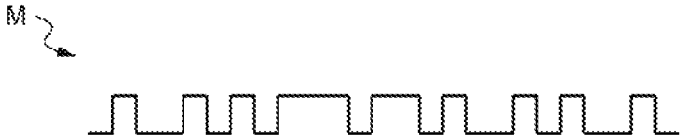
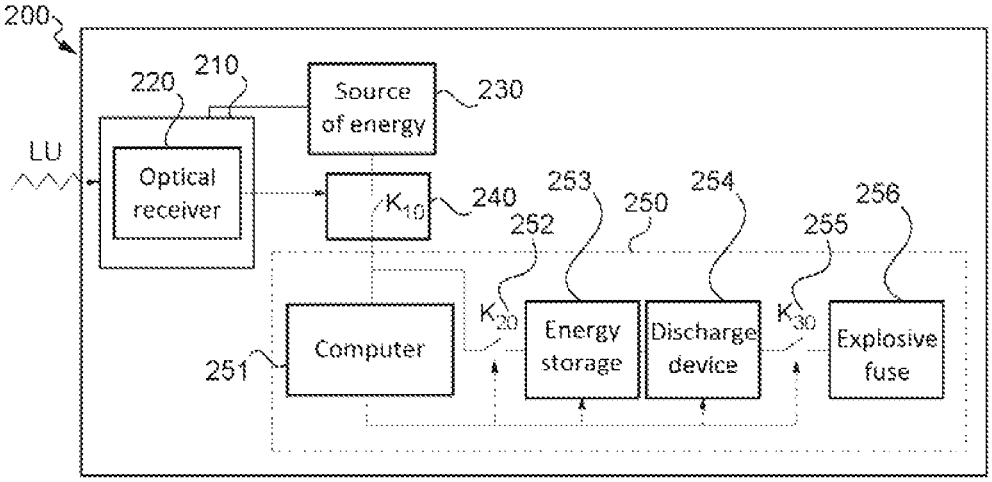
Fig.3

WIRELESS ELECTRONIC DETONATOR COMPRISING A POWER SWITCH CONTROLLED BY AN OPTICAL SIGNAL, WIRELESS DETONATION SYSTEM AND METHOD FOR ACTIVATING SUCH A DETONATOR

RELATED APPLICATIONS

This application is a § 371 application of PCT/FR2020/052324 filed Dec. 7, 2020, which claims priority from French Patent Application No. 1913940 filed Dec. 9, 2019, each of which is incorporated herein by reference in its entirety.

FIELD OF THE INVENTION

The present invention relates to a wireless electronic detonator.

The invention also relates to a wireless detonation system as well as a method for activating the electronic detonator.

Here, activation method means turning the electronic detonator on or off, independently of its ignition.

BACKGROUND OF THE INVENTION

The use of the invention is in the field of pyrotechnic initiation, in any sector in which a network of one or more detonators must conventionally be implemented. Typical examples of use relate to the exploitation of mines, quarries, seismic exploration, or the sector of construction and public works.

During their use, electronic detonators are respectively placed in locations arranged to receive them and intended to be loaded with explosives. These locations are for example holes dug in the ground. The ignition of the electronic detonators is then carried out according to a predetermined sequence.

To arrive at this result, an ignition delay is associated individually with each electronic detonator, and a shared firing order is broadcast to the network of the electronic detonators via a control console.

This shared firing order allows to synchronize the countdown of the ignition delay for all of the electronic detonators.

Upon reception of the firing order, each electronic detonator manages the specific countdown of the ignition delay that is associated with it, as well as its own ignition.

Wireless electronic detonators, activated by a remote control console configured to communicate by radio waves with the detonators, for example to exchange with them commands or messages relative to their state, or to address to them an ignition order, are known. Energy independence is therefore an important condition for the creation of a wireless detonator.

The document WO 2019/073148 describes a wireless electronic detonator including a source of energy and functional modules, as well as first switching means disposed between the source of energy and the functional modules, allowing to connect or to not connect the energy source to the functional modules, and a module for controlling the first switching means including a module for recovering radio energy configured to receive a radio signal coming from a control console, recover the electric energy in said received radio signal, generate an energy recovery signal representative of the level of electric energy recovered, and generate at the output a control signal according to the recovered energy, said control signal controlling said switching means.

Thus, a radio signal is sent by the control console to the detonator. On the detonator side, the principle involves recovering the energy present in the radio signal using a suitable reception system, that is to say the module for recovering radio energy, in order to control a power switch mechanism. This solution provides in particular the following advantages:

- the activation does not have mechanical elements to manipulate, which allows to design a totally impermeable case for the detonator, robust against environmental conditions and handling, and thus increase the reliability of the system;
- the activation of the detonator can only be carried out by a person having the appropriate control console, thus limiting the possibility of being activated by any given person not having the required equipment;
- the system is simple and fast to use: it suffices to approach the console for activating the detonator to tele-power the switch system and start an automatic controller of the wireless detonator.

This system has, however, disadvantages.

In particular, the range of the radio detonation system is rather limited. In practice, it does not exceed several tens of centimeters because of the limitations on radio power imposed by the regulations, which is an obstacle to easy use.

Moreover, it is not always possible to unambiguously target a specific detonator, especially when several detonators are close to each other. This discrimination is, however, imperative, lest a wrong detonator be associated with the firing pattern, or an incorrect ignition delay be assigned to a detonator. There are techniques based on proximity, the directivity of the antennas, or the estimation of distance between the activation console and the detonator, for example proposed in the document WO 2019/073148, but their practical implementation is complicated.

OBJECT AND SUMMARY OF THE INVENTION

In this context, one goal of the present invention is to at least partly overcome the aforementioned disadvantages, while further being able to lead to other advantages.

The object of the present invention aims in particular to propose a technique for remote activation offering a more efficient solution to the problems mentioned above.

In particular, the object of the present invention relates to a system for controlling a switch, that is to say to the mechanism allowing to activate, or not, the detonator.

For this purpose, according to a first aspect of the invention, a wireless electronic detonator is proposed including a primary source of energy and at least one functional module, a power switch, disposed between the primary source of energy and the functional module, configured to connect or disconnect the functional module and the primary source of energy, and a module for controlling the power switch, characterized in that the module for controlling the power switch includes an optical receiver configured to detect and demodulate a light signal emitted by a control console and generate at the output a control signal according to the demodulated light signal, the control signal being configured to at least control the power switch.

Thus, the detonator is configured to receive and demodulate the light signal received from the control console (also called tele-activation console).

When the light signal is demodulated correctly, the power switch is activated and the rest of the electronics of the detonator are powered on.

The primary source of energy is configured to power the various other elements of the detonator via the power switch.

It includes for example an onboard source of energy, or a module for recovering energy combined with a local energy storage, or a module for providing energy connected by cable.

The primary source of energy is for example also configured to transfer energy to an energy storage element dedicated to the ignition of an explosive fuse of the functional module.

The power switch can be similar to one of the embodiments presented in the document WO 2019/073148.

The power switch includes for example a switch.

According to the invention, the detonator includes a module for controlling the power switch, that is to say a control module configured to control the power switch.

Thus, the control module is for example configured to receive an ignition command and order an ignition of the explosive fuse according to said ignition command.

For this, the control module mainly includes the optical receiver.

In a preferred exemplary embodiment, the optical receiver includes an optical detector configured to detect the light signal emitted by the control console and convert the light signal into an electric signal.

For example, the optical detector includes a photodiode, to which a detection resistor is optionally added.

In a preferred exemplary embodiment, the detonator further includes a demodulator configured to demodulate the electric signal.

According to an exemplary embodiment, the demodulator includes an analog conditioner configured to transform the electric signal coming from the optical detector, which is analog, into a digital signal.

The analog conditioner includes for example at least one high-pass filter, configured to eliminate a static component of the light beam, or even a pass-band filter.

According to an exemplary embodiment, the demodulator includes a digital processing module configured to demodulate the digital signal, for example in order to detect the binary sequence emitted by the control console, and generate a control signal to control the power switch, for example according to the binary sequence.

The digital processing module includes for example at least one computer, and optionally a memory element.

Here, a memory element designates both a conventional memory and a register.

For example, the signal received is correlated with a reference signal, for example recorded in the memory element, so as to detect an activation sequence.

According to a result of the correlation, the digital processing module is configured to generate a signal for controlling the power switch.

In all cases, the optical receiver presented here must be powered.

However, ideally, the detonation system must consume as little energy as possible, to avoid reducing the battery life of the detonator before its use on the ground, and conserve as much as possible the energy of the primary source of energy.

The consumption must therefore be as low as possible.

The consumption of the optical detector and of the digital processing module are the ones to be reduced first and foremost, to aim at a consumption of the system of approximately several microamperes, if possible.

The optical detector generally has a consumption that is directly proportional to the lighting.

According to a first example, the detonator advantageously includes at least one optical filter upstream of the optical detector, in order to reduce the intensity of the ambient lighting, without reducing the detection performance.

One goal is to maximize the received light power corresponding to the optical signal, while reducing as much as possible the received power corresponding to the ambient lighting.

This allows to reduce the current consumed by the optical detector linked to the intensity of the ambient lighting.

According to a second example, the optical detector advantageously includes a photovoltaic element.

The detector is thus used here in photovoltaic mode.

For this, for example, it is not polarized by a power supply voltage.

An assembly of this type allow to eliminate, possibly totally, the consumption of the optical detector.

The consumption is thus very well controlled, and is more independent of the surrounding lighting conditions.

According to a third example, the detonator includes a low-consumption mode configured to cut off the power supply to at least the digital processing module, which allows to limit the electricity consumption of the system.

Thus, for example, under natural lighting, the light intensity varies slowly, there is therefore no variation at the output of the analog conditioner, because of the high-pass filtering.

As soon as a sudden variation in lighting occurs, a transition appears at the output of the analog conditioner, used to awaken the digital processing module.

This functionality can typically be implemented via a low-consumption mode of a microcontroller.

The consumption can thus be reduced to less than one microampere (1 μA).

According to a fourth example, in order to avoid any residual consumption during a period of storage of the detonator for example (which can last several months before its use), a cutoff of the power supply to the optical receiver depending on the level of lighting is used ("darkness mode").

The detonator thus includes for example a general cutoff module configured to cut off a power supply to the optical receiver.

The general cutoff module includes for example a phototransistor with high gain (for example 40 μA/100 lux), optionally coupled with a detection resistor configured to detect a very low level of lighting, typically less than 100 lux, or even 80 lux, or even 60 lux, or even 40 lux, or even 20 lux, or even 1 lux.

The detonator, or even for example the general cutoff module, also includes for example a transistor, acting as a switch, and the detection resistor is configured to control the transistor.

In this way, when the detonator is in the darkness, stored in a box for example, the power supply to the optical receiver is totally cut off. The consumption is thus almost zero (except for the leak currents of the transistor and of the phototransistor, which are negligible).

When the detonator is taken out of the box to be used, the general cutoff module powers the optical receiver, the detonator is thus waiting for an optical activation coming from the user (via the control console).

The functional module includes here for example at least one explosive fuse.

According to an exemplary embodiment of interest, the functional module further includes an energy storage element dedicated to the ignition of the explosive fuse.

For security, the functional module also advantageously includes a switch for insulating the energy storage element configured to activate or deactivate the transfer of energy from the primary source of energy to the energy storage element.

Also for security, the functional module can also include a discharge device, configured to slowly discharge the energy storage element in order to go back to a state of security in the case of powering off of the detonator for example.

According to an option of interest, the functional module can thus also include an ignition switch configured to allow a transfer of energy between the energy storage element dedicated to the ignition and the explosive fuse.

According to an exemplary embodiment, the functional module further includes a computer configured to control the operation of the detonator.

The computer is for example connected, or disconnected, from the primary source of energy via the power switch.

Thus, the computer is for example configured to receive a signal and order an ignition of the explosive fuse of the functional module according to said signal.

According to another option of interest, the detonator is configured to emit a return signal when the optical receiver of the detonator has at least detected the light signal emitted by the control console.

The user can for example be alerted that the light signal emitted by the control console has been at least detected by at least the targeted detonator.

Thus, the powering on of the detonator is carried out by optical activation.

For example, the detonator is configured to emit a return signal directly perceptible to the user, for example a visual or sound signal.

According to another example, the detonator is configured to emit a return signal configured to be consequently detected by the control console, for example a radio signal.

Such a detonator has at least the same advantages as the prior art presented above, in particular:

- in terms of reliability: it allows to create an impermeable case and to eliminate mechanical elements, the risks of a bad contact are limited or even avoided, etc.
- in terms of security: it is necessary to have the appropriate control console (which includes the light source) to activate the detonator,
- or in terms of ease and quickness of implementation: it is not necessary to connect a control console physically and electrically to the detonator to activate it and the activation is carried out without contact.

And such a detonator also has at least the advantage of providing a simplified operating mode via the range of the tele-activation: for example, it is not necessary to use an accessory to activate a detonator, for example a pole to activate a detonator on the ground without bending down, or a nacelle to activate a detonator positioned high up in an underground gallery.

According to a second aspect of the invention, a wireless detonation system is also proposed including a wireless electronic detonator, including at least a part of the aforementioned features, and a control console configured to emit a light signal to said wireless electronic detonator.

In practice, a user thus directs the light signal in the direction of the detonator that they desire to activate.

The wireless detonation system has the features and advantages analogous to those described above in relation to the wireless electronic detonator.

Moreover, such a detonator associated with a corresponding control console further has at least the following advantages:

- In terms of range: the range is increased, allowing in practice to activate the detonator at a distance of several meters, according to the ambient luminosity and the power of the light source.
- In terms of regulations: the system is not subjected to restrictive regulations like for the radio activation system presented in the prior art, which allows to develop a system with better performance.
- In terms of safety: the control console allows to precisely target the desired detonator, and the pointing of the light beam can be perfectly visible to the user if the signal is emitted in the visible range, which avoids any ambiguity.
- In terms of flexibility: the system adapts to cases of use that differ from the normal case. A simultaneous activation of a group of detonators is indeed possible, by using a wider lens allowing to illuminate several detonators. This technique can be beneficial in an underground context, or when the firing pattern has already been established and the goal is to very quickly power on a plurality of detonators.

In a particularly convenient exemplary embodiment, the control console includes a light source, configured to emit the light signal.

The light source is preferably configured to emit a light signal in the visible range, that is to say a light signal having a wavelength between approximately 400-800 nm.

However, the light signal can also be emitted in the infrared (IR) or ultraviolet (UV) according to the needs of the use.

The techniques used are identical.

With respect to the visible range, a light signal emitted in the IR or the UV is not perceptible (visible) to the user, which can make the use of the detonator system less easy, in particular for targeting a precise detonator.

To overcome this difficulty, the detonation system thus advantageously includes a system for assisting pointing.

However, a system for assisting pointing can also be useful when a signal in the visible range is used.

For example, according to the power of the optical beam or if the ambient luminosity is significant, the light signal can possibly be less easily perceptible.

Aiming at a detonator is thus more complicated for the user.

In a practical example, the control console includes a detector configured to detect the return signal emitted by the detonator.

According to an option of interest, the control console further includes an indicator configured to emit an alert signal, for example visual or sound, allowing to alert the user that the light signal emitted by the light source has at least been detected by at least the targeted detonator, or to say that the return signal has indeed been detected by the control console.

The control console thus includes for example an LED or a buzzer.

Such a configuration of the detonation system thus forms a system for assisting pointing.

The detonator is thus for example configured to emit a return when it is illuminated by the beam of the control console.

Thus, in an exemplary embodiment of interest, the control console is configured to emit a light signal continuously, either for a predetermined time, or on demand by the user.

The user illuminates the zone in which the detonator is located, or even more particularly the optical receiver of the detonator, with a sweeping movement.

When the expected light sequence is detected by the detonator, a simple visual return, for example via an LED, or sound, for example via a buzzer, is triggered by the detonator.

According to yet another option of interest, the control console further includes a lens configured to focus the light signal towards at least one detonator.

The lens designates here an optical lens, called adjustable or variable.

The use of such a lens allows greater flexibility of the system.

For example, a simultaneous activation of a group of detonators is thus possible, by using a wider lens allowing to illuminate several detonators.

This technique can be beneficial in an underground context, or when the firing pattern has already been established and the goal is to very quickly power on several or all of the detonators.

In terms of safety, the lens used on the control console allows to precisely target the desired detonator(s).

In another exemplary embodiment, the control console further includes a modulator configured to modulate the light signal according to at least one modulation pattern.

Thus, the light signal can be modulated with a modulation pattern allowing to distinguish it from the natural, or artificial, ambient lighting in order to avoid the detonator being powered on in an untimely manner.

Thus, advantageously, the modulated light signal includes at least one activation sequence.

One advantage of the detonation system using optical modulation is thus that it is possible to use the modulated signal to send useful digital data to the detonator.

It allows for example:

- To directly transfer the ignition delay to the detonator during its optical activation.
- To provide the identifier of the console by which the detonator has been activated or the identifier of the ignition console that will be used, which allows several teams to simultaneously deploy networks of detonators in the same zone.
- To provide an ignition code specific to the detonator, allowing to avoid any accidental ignition of detonators not having the specified code.

Thus, for example, the modulated light signal includes a data sequence configured to send instructions to the detonator, for example a delay value, and/or an identifier, and/or an ignition code, or others.

The data sequence is transmitted after the activation sequence in the light signal.

Moreover, in the case of a light beam emitted in the visible, the targeted detonator is visually identified by the user and the information can be intercepted or scrambled with difficulty, making the system more secure.

According to yet another option of interest, the modulated light signal includes a stop signal.

In order to carry out the same function as a manual switch, the detonation system using optical modulation preferably allows to power off a detonator.

This provides an additional level of security, in the case for example in which abandoning of the firing is decided, or simply to stop a detonator powered on by mistake.

With a view to using this stop function, two different sequences can be used: a sequence for the powering on, another sequence for the powering off.

Consequently, the control console includes for example a selection module, configured to allow the user to select one sequence or the other (that is to say an activation sequence or a stop sequence).

Finally, according to a third aspect, a method is proposed for activating a wireless electronic detonator including a primary source of energy, at least one functional module, a power switch, disposed between the primary source of energy and the functional module, configured to connect or disconnect the functional module and the primary source of energy, and a module for controlling the power switch.

According to the invention, the method includes the following steps:

- Receiving a light signal;
- Demodulating the light signal received;
- Generating a control signal, according to the demodulated light signal, the control signal being configured to at least control the power switch.

Thus, the functional module of the electronic detonator is activated, or powered on, via the power switch, disposed between the primary source of energy and the functional module which is controlled by a control signal generated when the demodulated light signal corresponds to at least instructions for activation of the electronic detonator.

The activation method has the features and advantages analogous to those described above in relation to the wireless electronic detonator and the wireless detonation system.

According to an embodiment of interest, the step of receiving a light signal includes a step of detecting a light signal and a step of converting the light signal into an electric signal.

According to an embodiment of interest, the demodulation step includes a step of transforming the electric signal into a digital signal and a step of identifying at least one activation sequence in the digital signal.

If an activation sequence is identified, then the step of generating a control signal includes a step of activating the power switch.

For example, if the digital signal corresponds to a reference signal including at least one activation sequence, the power switch is activated.

Here, activation means powering on or powering off of the electronic detonator, independently of its ignition, in other words its control.

According to an option of interest, the demodulation step further includes a step of identifying at least one data sequence in the digital signal.

If a data sequence is identified, then the step of generating a control signal includes a step of generating instructions corresponding to the data sequence.

For example, once an electronic detonator is powered on, a delay for the ignition can be associated with it.

This association can be implemented immediately or after a time after its powering on.

According to various embodiments, the powering on and the association of the delay can be carried out with the same control console or with different control consoles.

Thus, the deployment of the electronic detonators can be carried out in different ways.

In the case of association of a delay with different control consoles for the powering on and the association of delay, the powering on can be carried out at the time of installation, and the association of the delay can be carried out later, once all of the detonators have been powered on.

In the case of a later association of the delay, all of the electronic detonators are first powered on at the time of their installation via the control console. Then, the electronic detonators can be put to sleep or on standby with a periodic awakening procedure. Once all of the electronic detonators have been installed and powered on, delays are associated with all of the electronic detonators. For this, the electronic detonators can be equipped with any given location system (for example a GPS, a system measuring relative distances or received powers between each electronic detonator of the network, optionally requiring a post-processing step, etc.). The raw data relative to each electronic detonator (for example the absolute position, relative distances or received powers, etc.) are collected for example by radio with the control console, in order to produce a map of the network of electronic detonators with their identifiers. With knowledge of this map, it is then possible to association a delay with each electronic detonator.

An inconsistency observed between an intended firing pattern and the real map of the electronic detonators can be detected, allowing to power off detonators having this inconsistency.

When the powering on and the association of the delay are carried out with different control consoles, these two operations are carried out at moments distant in time, ranging from several minutes to several hours or even several days according to the case. Powering-off conditions can be considered in the interval to allow the electronic detonator to return to a powered-off state. For example, in the case of non-solicitation by a light signal after a certain time, or without exchange or reception of messages with the control console during operations of periodic awakening of the electronic detonator, the digital processing module can power off the electronic detonator.

In the end, each of these approaches ends with the execution of a conventional ignition procedure.

BRIEF DESCRIPTION OF THE DRAWINGS

The invention, according to an exemplary embodiment, will be well understood and its advantages will appear better upon reading the following detailed description, given for informational and in no way limiting purposes, in reference to the appended drawings in which:

FIG. 1 outlines a detonation system according to an exemplary embodiment of the invention;

FIG. 2 shows an example of a pseudo-random sequence following a modulation pattern;

FIG. 3 shows a wireless detonator according to an exemplary embodiment of the invention;

Identical elements shown in the aforementioned drawings are identified by identical numerical references.

DETAILED DESCRIPTION OF THE EMBODIMENTS

Figure 4:
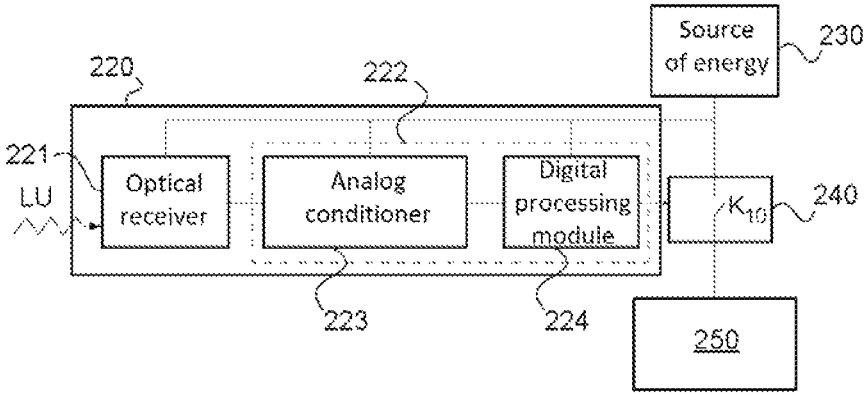
FIG. 4 outlines an exemplary embodiment of an optical receiver.

According to an exemplary embodiment of an aspect of the invention outlined in FIG. 1, a detonation system 10 mainly includes:

- a control console 100 configured to emit a modulated light signal LU, and
- a detonator 200, autonomous in terms of energy, configured to detect and demodulate the light signal LU of the control console 100.

According to an exemplary embodiment, the control console 100 includes a modulated light source.

As outlined in FIG. 1, the control console 100 includes for example a light source 110 configured to emit a light beam including a light signal, and a modulator 120 configured to modulate the light signal according to at least one modulation pattern.

The light source 110 is preferably configured to emit a light signal in the visible range, that is to say a light signal having a wavelength between approximately 400-800 nm.

A light source configured to emit a signal in the infrared or the ultraviolet can however be used, according to the needs or the intended use.

According to an option not shown, the control console can further include a variable lens, also called adjustable, configured to focus the light signal towards one or more detonators.

The control console can thus activate a single detonator, for example if the lens is adjusted to transmit a narrow beam, or simultaneously activate a group of detonators, if the lens is adjusted to transmit a wider beam allowing to illuminate several detonators.

According to an option of interest, the detonator is configured to emit a return signal when it is illuminated by the beam of the control console.

The detonator includes for example a visual or sound indicator.

The detonator can also be configured to emit a return signal configured to be consequently detected by the control console, for example a radio signal.

According to at least one other option of interest, the control console 100 can also include a detector, configured to detect a return signal emitted by the detonator, and an indicator, for example visual or sound, configured to alert the user that the light signal emitted by the light source 110 has at least been detected by at least the targeted detonator, or that the return signal has indeed been detected by the control console.

The indicator, of the control console or of the detonator, includes for example an LED or a buzzer.

The detonation system is thus provided with a system for assisting pointing.

The control console preferably emits the light sequence continuously, either for a predetermined time, or on demand by the user.

The user illuminates the zone in which the detonator 200 is located, or even more particularly an optical receiver 220 of the detonator 200 (described below), with a sweeping movement.

When the expected light sequence is detected by the detonator, a simple visual return, for example via an LED, or sound, for example via a buzzer, is triggered by the detonator.

FIG. 2 shows an example of a modulation pattern M used to modulate the light signal LU emitted by the control console 100.

This is in particular in this figure an OOK (On/Off Keying) modulated pseudo-random sequence, but other types of optical modulations are possible.

A modulation of the OOK type has the advantage of being simple to implement, and not very complex to demodulate, which allows to limit the cost of the detonator.

Preferably, a pseudo-random sequence known to the receiver is used to modulate the optical signal emitted by the console, in order to be able to distinguish it with the least error possible from a natural or artificial light (certain artificial lighting indeed has a hashed signal in the form of a square wave).

The size of the pseudo-random sequence must be sufficiently long, typically greater than 32 bits, in order to avoid false alarms.

Preferably, a modulation rate (frequency) is typically between 100 Hz and 10 kHz.

This value is sufficient to not be too sensitive to the movements of the user, and is not too high to be able to limit the cost of the receiver 220 by using for example a photodiode 231 (outlined in FIG. 5) having limited performance.

This example is not limiting. Other types of modulation, other types of sequences, other modulation rates could be used.

Another advantage of the system by optical modulation is to be able to use the modulated light signal to transmit information, that is to say digital data, useful to the detonator, optically.

For this, in the control console, the modulated light signal LU includes for example preferably an activation sequence having good autocorrelation properties, typically a Kasami sequence.

This allows the receiver, i.e. the detonator, to suitably synchronize itself on the received signal in order to extract the data therefrom.

The data sequence includes for example binary data that is simply concatenated after the activation sequence.

The message sent by the control console includes for example the following sequences: [activation sequence]-[data sequence].

The data sequence is configured to send for example a delay value, and/or an identifier, and/or an ignition code, or others.

According to one example, an integrity control of the CRC (Cyclic Redundancy Check) type can optionally be added to the message, in order to be able to control the result of the demodulation of the data sequence in the detonator (i.e. of the receiver).

The message sent by the control console thus includes for example the following sequences: [activation sequence]-[data sequence]-[control sequence].

According to another example, it would also be possible to add a correction code.

The message sent by the control console thus includes for example the following sequences: [activation sequence]-[data sequence]-[control sequence]-[correction sequence].

Thus, according to an exemplary embodiment, it is possible to use a block code of the Hamming type, which includes a data sequence and a correction sequence.

On the receiver side, i.e. detonator side, conventional digital demodulation techniques can be used.

The activation sequence allows to synchronize the receiver on the beginning of the sent message.

A simple regular sampling, or a front detection, then allows to demodulate the contents of the message.

According to yet another option of interest, the modulated light signal LU includes a stop signal.

In order to carry out the same function as a manual switch, the detonation system using an optical modulation preferably allows to power off a detonator.

This provides an additional level of security, in the case for example in which abandoning of the firing is decided, or simply to stop a detonator powered on by mistake.

With a view to using this stop function, two different sequences can be used: a sequence for the powering on, another sequence for the powering off.

The two sequences are preferably quasi-orthogonal, in order to limit the risks of poor detection of the sequence emitted.

For example, two different Kasami sequences allow to satisfy this condition.

One alternative can be to use the sign of the sequence: normally emitted, the sequence leads to a positive correlation peak for the start-up, but emitted in an inversed manner, it thus gives a negative correlation peak, for example for the stoppage.

In the end, a single correlator is necessary, only the sign of the result making the difference.

Kasami sequences are, however, preferred since they give a result close to 0 for an intercorrelation, regardless of the offset between the sequences.

Consequently, the control console must allow the user to select one sequence or another (that is to say an activation sequence or a stop sequence).

In the receiver, a digital processing module of the optical receiver of the detonator (described below) is for example configured to detect one sequence or the other. Correlation processings are for example duplicated, by alternatingly using one sequence then the other as a reference sequence.

FIG. 3 shows an exemplary embodiment of a detonator 200.

The detonator 200 according to the invention, autonomous in terms of energy, mainly includes here a control module 210 that includes an optical receiver 220 configured to activate the detonator optically.

The optical receiver 220 allows in particular to demodulate the light beam LU send by the console 100, and generate a signal for controlling the power switch 240.

Moreover, the detonator 200 includes for example here the following elements:

- A primary source of energy 230 (for example an on board source of energy, or a module for recovering energy combined with a local energy storage, or a module for providing energy connected by cable), allowing to power the various other elements of the detonator via a power switch 240 and to transfer energy to an energy storage element 253 dedicated to the ignition of an explosive fuse 256.
- The power switch 240, for example including a K10 switch, allowing to control the powering on of various electronic elements of a functional module 250 from the primary source of energy 230. This power switch 240 can be similar to one of the embodiments presented in the document WO 2019/073148.

And the functional module 250.

The functional module 250 includes here for example the following electronic elements:

A computer 251 allowing to control the operation of the electronic detonator. The computer 251 is connected, or disconnected, from the primary source of energy 230 via the power switch 240.

The energy storage element 253 dedicated to the ignition of the explosive fuse 256.

A switch 252 for isolating the energy storage element, including for example a K20 switch, allowing to activate or deactivate the transfer of energy from the primary source of energy 230 to the energy storage element 253, independently of the transfer of energy from the primary source of energy 230 to the computer 251.

A discharge device 254, forming a security mechanism allowing a slow discharge of the energy storage element 253 dedicated to the ignition, in order to go back to a state of security in the case of powering off.

An ignition switch 255, including for example a K30 switch, allowing the transfer of the energy between the energy storage element 253 dedicated to the ignition and the explosive fuse 256.

And the explosive fuse 256.

The optical receiver 220 according to an exemplary embodiment is outlined in FIG. 4.

The optical receiver 220 of FIG. 4 mainly includes:

an optical detector 221, configured to convert the light signal LU received into an electric signal; and a demodulator 222 configured to demodulate the light signal received and generate a signal for controlling the power switch 240.

Here, the demodulator 222 includes for example:

an analog conditioner 223, configured to transform the electric signal of the optical detector 221, which is analog, into a digital signal; and a digital processing module 224, configured to demodulate the digital signal in order to detect the binary sequence emitted by the control console 100 and generate a control signal to at least control the power switch 240 according to the binary sequence.

Here, the digital processing module 224 and/or the computer 251 are for example configured to:

manage the operation of the electronic detonator 200;

analyze the messages received via the control console 100;

act according to the meaning of the messages received;

activate the storage of energy in the energy storage element 253 for the ignition;

carry out the countdown of the ignition delay associated with the electronic detonator 200;

activate the transfer of energy from the energy storage element 253 to the explosive fuse 24 after the countdown, via the ignition switch 255;

activate the discharge device 254;

control the power switch 240;

control the isolation switch of the energy storage element 252.

Figure 5:
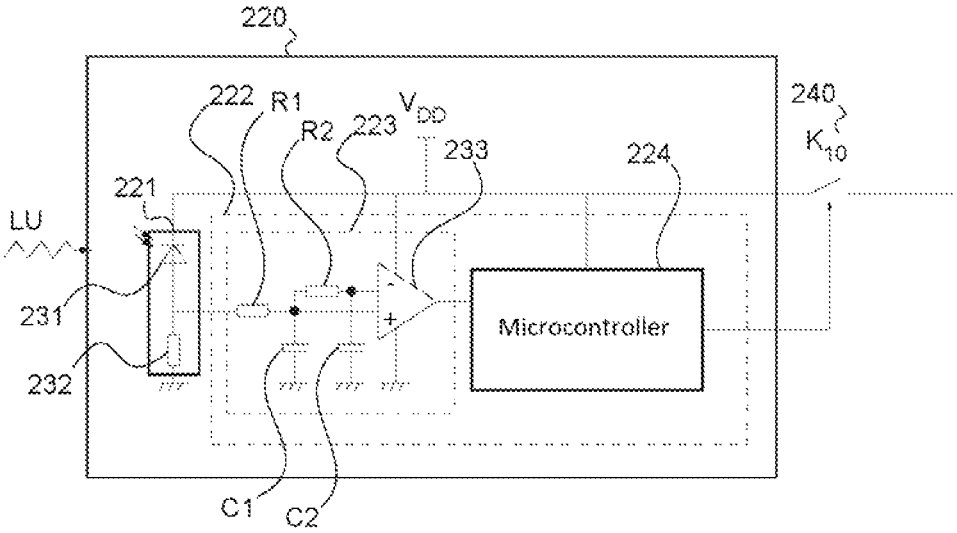
FIG. 5 illustrates a first exemplary embodiment of an optical receiver.

FIG. 5 shows an exemplary embodiment of the optical receiver 220 outlined in FIG. 4.

The optical detector 221 includes here a photodiode 231 that converts the light signal LU into electric current.

The optical detector 221 also includes here a detection resistor 232 that allows to process a voltage, usable by the analog conditioner 223.

The detection resistor 232 is dimensioned in such a way that the signal is not saturated under strong luminosity, which would make the system ineffective. Inversely, a value that is too low reduces the dynamics of the electric signal, entailing a reduction in the range of the detonation system.

By supposing a maximum possible lighting of Emax (typically 130,000 lux), and a sensitivity of the photodiode 231 of S A/lux, and a power supply voltage Vdd, the detection resistor 232, having a resistance noted as R, must verify the relationship $Vdd=R\times S\times Emax$ to be at the limit of saturation under maximum lighting.

The dimensioning of the pair [photodiode 231-detection resistor 232] thus determines for the most part the performance of the system in terms of range.

The analog conditioner 223 includes here at least one high-pass filter, in order to eliminate the static component related to the natural lighting and to the movements of the user.

It can include a pass-band filter (which thus corresponds to a high-pass filter to which a low-pass filter has been added) to also eliminate possible high-frequency disturbers.

In the example of implementation shown in FIG. 5, the analog conditioner 223 includes a pass-band filter (a pair $R_1C_1$ (resistor-capacitor) on a "+" (plus) pin of a comparator 233 determines the high frequency and a pair $R_2C_2$ on a "–" (minus) pin the low frequency) allowing to eliminate the static component of the signal, related to the level of ambient lighting.

The filtered signals are injected into the comparator 233 to obtain a binary signal at the output of the comparator 233, thus at the output of the analog conditioner 223.

The analog conditioner 223 includes for example a comparator and/or an operational amplifier.

Finally, the digital processing module 224, into which the digital signal is injected, includes for example at least one computer (typically a microcontroller or a dedicated digital circuit), and optionally a memory element.

The received signal is correlated with the expected reference signal, in such a way as to detect the presence of an activation signal.

The expected reference signal is possibly prerecorded in the digital processing module 224.

At this level, any known technique for demodulation of a digital signal can be used.

When the activation sequence is detected, the digital processing module 224 generates a control signal configured to control the power switch 240 in an active position, for example in a closed position if this is a switch, in such a way as to power on the other elements of the detonator.

These functionalities can, however, be carried out differently from the embodiment outlined in FIG. 5.

For example, in order to share the hardware resources, it is for example possible to carry out the digital processing in the computer 251 of the functional module 250. The general architecture must thus be slightly redone, in such a way as to assemble the computer 251 upstream of the power switch 240.

In other words, the computer 251 of the functional module 250 and the digital processing module 224 can thus be grouped together into a single entity, preferably located upstream of the power switch 240, for example in the optical receiver 220.

Moreover, a part of the computer can remain "inactive" (in low-consumption mode) as long as the light sequence has not been received.

It is also possible to use other strategies to demodulate the light signal, which lead to a different hardware architecture of the optical receiver 220. For example, the analog conditioner 223 could be replaced by a digitization using an ADC (Analog-to-Digital Converter) of the raw signal coming from the optical receiver, which can then be processed directly by the computer of the digital processing module 224.

In all cases, the optical receiver presented needs to be powered.

However, ideally, the detonation system must consume as little energy as possible, to avoid reducing the battery life of the detonator before its use on the ground.

The consumption must therefore be as low as possible for the system to be of as much practical interest as possible.

The optical receiver 220 generally has a consumption that is directly proportional to the lighting.

Typically, for a photodiode having a sensitivity of 40 nA/100 lux, the consumption is 52 μA under a maximum sunlight of 130,000 lux.

The consumption of the analog conditioner 223 is typically located between 1 μA and 30 μA according to the comparator or the operational amplifier used.

The choice of a comparator 233 having a reduced [gain× bandwidth] product allows to select components, the consumption of which is located around one microampere (μA).

This occurs to the detriment of the allowed modulation rate, but this is not a critical element of the system.

Finally, the digital processing module 224 typically consumes several milliamperes when the processing is carried out.

The consumption of the optical detector 221 and of the digital processing module 224 is thus that which must be reduced first and foremost, to aim at a consumption of approximately several microamperes, if possible.

A first approach thus involves for example adding an optical filter in front of the photodiode 231 of the optical detector 221, in order to reduce the intensity of the ambient lighting, without reducing the detection performance.

One goal is to maximize the received light power corresponding to the optical signal, while reducing as much as possible the received power corresponding to the ambient lighting.

This allows to reduce the current consumed by the optical detector related to the intensity of the ambient lighting.

Figure 6:
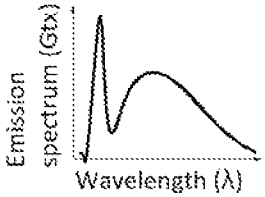
FIG. 6 schematically shows an example of an emission spectrum of a light source containing LEDs according to the wavelength.
Figure 7:
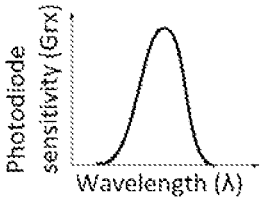
FIG. 7 schematically shows the spectral sensitivity of a photodiode according to the wavelength.

The light source of the control console 100 has a very particular emission spectrum (FIG. 6), and the photodiode 231 has a characteristic spectral sensitivity (FIG. 7).

These two elements thus behave as gain filtering stages Gtx(λ) and Grx(λ), dependent on the wavelength λ of the light signal emitted by the control console 100.

The optical power Prx converted by the photodiode 231 into electric power is thus expressed according to the power Ptx emitted by the console, the attenuation related to the distance R, the illuminated solid angle Ω, and the respective gains Gtx and Grx, according to the following formula:

$$Prx=[(Grx\cdot Gtx)/\Omega R^2]\cdot Ptx$$

Figure 8:
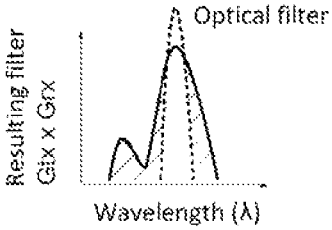
FIG. 8 shows the spectral characteristics of a filter resulting from the emission spectrum of FIG. 6 and the sensitivity of the photodiode of FIG. 7 according to the wavelength.

For a given distance and focal distance, the received power is maximum when the gain (Gtx·Grx) is maximum, that is to say for a given wavelength λ (FIG. 8).

The addition of an additional filter around this wavelength thus allows to maximize the reception at this wavelength, and reduce the reception on the other wavelengths, which corresponds to the desired goal.

The optimal width of the optical filter is thus calculated according to the response of the filter with respect to the natural light, which it is desired to reduce.

In practice it is thus possible to reduce by a factor of 3 the consumption of the optical detector.

A second approach involves for example using the photovoltaic effect of a photodetector 234 for the optical detector 221.

Figure 9:
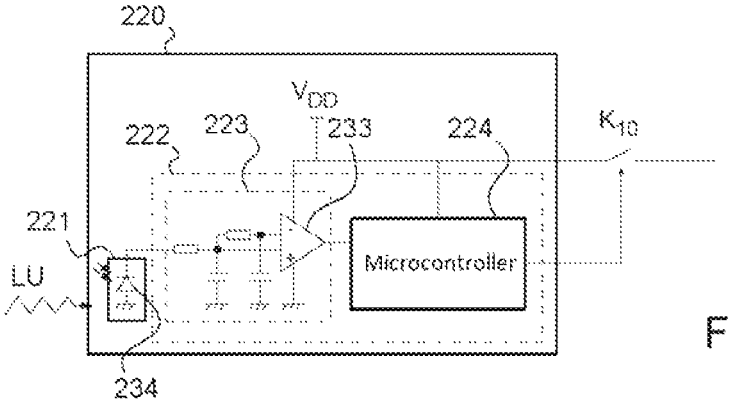
FIG. 9 illustrates a second exemplary embodiment of an optical receiver.

The photodetector 234 is used here in photovoltaic mode, like in the assembly outlined in FIG. 9.

For this, it is not polarized by a power supply voltage.

A photodiode like in the preceding example does not allow to generate a current sufficient to be usable. It is necessary to increase the surface of the photosensitive element, by using a photovoltaic panel having reduced dimensions, or several photodiodes in parallel.

This assembly allows to eliminate, possibly totally, the consumption of the optical detector.

The consumption is thus very well controlled, and is more independent of the surrounding lighting conditions.

According to a third approach, it is also possible to cut off the power supply to the digital processing module in order to limit the consumption.

For example, the digital processing module 224 includes a low-consumption mode that allows to cut off the clock and optionally the power supply to the digital electronics.

The presence of a change of state on the digital signal at the output of the comparator is for example used to take the system out of low-consumption mode.

Thus, under natural lighting, the light intensity varies slowly, there is therefore no variation at the output of the analog conditioner, because of the low-pass filtering.

As soon as a sudden variation in lighting occurs, a transition appears at the output of the analog conditioner, used to awaken the digital processing module.

This functionality can typically be implemented via a low-consumption mode of a microcontroller.

The consumption can thus be reduced at least by a microampere (1 μA).

According to a fourth approach, in order to avoid any residual consumption during a period of storage of the detonator for example (which can last several months before its use), a general cutoff of the power supply depending on the level of lighting is used ("darkness mode").

Figure 10:
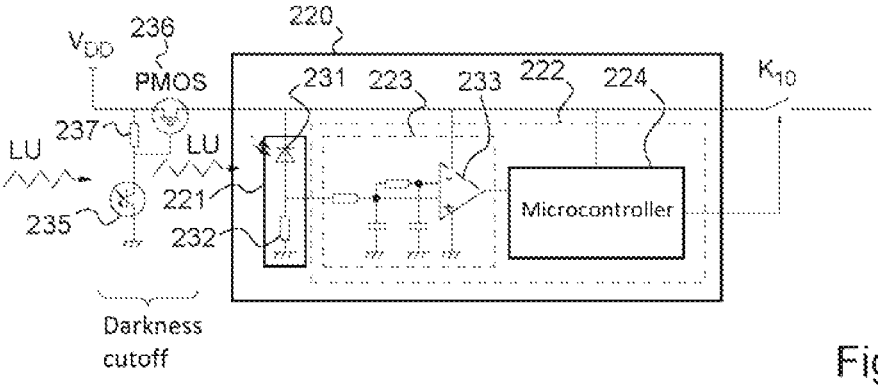
FIG. 10 illustrates a third exemplary embodiment of an optical receiver.

As illustrated in FIG. 10, a stage for additional detection of the level of lighting is used, with a setting allowing to voluntarily saturate the output signal as soon as a very low level of lighting appears.

For this, the stage for additional detection of the level of lighting includes for example a phototransistor 235 with high gain (for example 40 μA/100 lux) and a detection resistor 237, a setting value of which allows a detection of a very low level of lighting, typically several tens of lux.

The voltage at the terminals of the detection resistor 237 allows to control a transistor 236 acting as a switch.

Thus, the optical detection stage 221 remains unchanged. An additional stage upstream of the latter (but based on the same principle) is added, this additional stage having a different adjustment of the optical detection stage.

In this way, when the detonator is in the dark, stored in a box for example, the power supply is totally cut off. The consumption is thus almost zero (except for the leak currents of the transistor 236 and of the phototransistor 235, which are negligible).

When the detonator is taken out of the box to be used, the general cutoff stage powers on the optical receiver 220, the detonator is thus waiting for an optical activation coming from the user (via the control console).

The invention claimed is:

1. A wireless electronic detonator comprising:

an on-board primary source of energy, at least one functional module, a power switch disposed between the on-board primary source of energy and said at least one functional module, the power switch configured to connect or disconnect said at least one functional module and the on-board primary source of energy, and a controller to control the power switch, wherein said at least one functional module comprises at least one explosive fuse and an energy storage element dedicated to an ignition of said at least one explosive fuse, and the on-board primary energy source is configured to transfer energy to the energy storage element via the power switch; and wherein the controller comprises an optical receiver configured to detect and demodulate a light signal emitted by a control console and the controller generates at an output a control signal according to the demodulated light signal, the control signal being configured to at least control the power switch.

2. The detonator according to claim 1, wherein the optical receiver comprises an optical detector configured to detect the light signal emitted by the control console and convert the light signal into an electric signal.

3. The detonator according to claim 2, further comprising at least one optical filter upstream of the optical detector.

4. The detonator according to claim 2, wherein the optical detector comprises a photovoltaic element.

5. The detonator according to claim 2, further comprising a demodulator configured to demodulate the electric signal.

6. The detonator according to claim 5, wherein the demodulator comprises an analog conditioner configured to transform the electric signal from the optical detector into a digital signal.

7. The detonator according to claim 6, wherein the demodulator comprises a digital processor configured to demodulate the digital signal and generate the control signal to control the power switch.

8. The detonator according to claim 7, further comprising a low-consumption mode configured to cut off a power supply to at least the digital processor.

9. The detonator according to claim 1, further comprising a general cutoff module configured to cut off a power supply to the optical receiver.

10. The detonator according to claim 9, wherein the general cutoff module comprises a phototransistor with a high gain, coupled with a detection resistor configured to detect a very low level of lighting, and a transistor, acting as a switch, the detection resistor being configured to control the transistor.

11. The detonator according to claim 1 is configured to emit a return signal when the optical receiver has at least detected the light signal emitted by the control console.

12. A wireless detonation system comprising the wireless electronic detonator according to claim 1 and the control console configured to emit the light signal to the wireless electronic detonator.

13. The detonation system according to claim 12, wherein the control console comprises a lens configured to focus the light signal towards at least one detonator.

14. The detonation system according to claim 12, wherein the control console comprises a modulator configured to modulate the light signal according to at least one modulation pattern to provide a modulated light signal.

15. The detonation system according to claim 14, wherein the modulated light signal comprises at least one activation sequence.

16. The detonation system according to claim 14, wherein the modulated light signal comprises a data sequence configured to send instructions to the wireless electronic detonator.

17. A method for activating a wireless electronic detonator comprising an on-board primary source of energy, at least one functional module comprising at least one explosive fuse and an energy storage element dedicated to an ignition of said at least one explosive fuse, a power switch, disposed between the on-board primary source of energy and said at least one functional module, the power switch configured to connect or disconnect said at least one functional module and the on-board primary source of energy, and a controller to control the power switch, the method comprising steps of:

receiving a light signal;

demodulating the light signal received;

generating a control signal, according to the demodulated light signal, the control signal being configured to at least control the power switch; and transferring energy from the on-board primary energy source to the energy storage element when the power switch is activated in response to the control signal.

18. The activation method according to claim 17, wherein the step of receiving the light signal comprises detecting the light signal and converting the light signal into an electric signal.

19. The activation method according to claim 18, wherein the step of demodulating comprises transforming the electric signal into a digital signal and identifying at least one activation sequence in the digital signal; and wherein the step of generating the control signal comprises activating the power switch in response to an identification of an activation sequence.

20. The activation method according to claim 19, wherein the step of demodulating comprises identifying at least one data sequence in the digital signal; and wherein in response to an identification of a data sequence, the step of generating the control signal comprises generating instructions corresponding to the data sequence.

21. The detonator according to claim 1, wherein the at least one functional module further comprises a discharge device configured to discharge the energy storage element to provide security to the detonator when the detonator is powering off.

22. The detonator according to claim 1, wherein the at least one functional module further comprises an ignition switch configured to allow a transfer of energy between the energy storage element and the explosive fuse.

23. The detonator according to claim 1, wherein the power switch is disposed between the on-board primary energy source and all of the at least one functional module.

24. The detonator according to claim 1, wherein the at least one functional module further comprises an energy storage element isolation switch disposed between the on-board primary source of energy and the energy storage element, the on-board primary source of energy further configured to transfer energy to the energy storage element via the energy storage element isolation switch.

* * * * *